United States Patent [19]

Dana, III

[11] 4,158,922

[45] Jun. 26, 1979

[54] FLASHING DISCOSHOES

[75] Inventor: Alfred Dana, III, Tampa, Fla.

[73] Assignee: Disco Enterprises, Inc., Tampa, Fla.

[21] Appl. No.: 890,805

[22] Filed: Mar. 27, 1978

[51] Int. Cl.[2] ..... A43B 23/00; F21V 33/00

[52] U.S. Cl. ..... 36/137; 362/103

[58] Field of Search ..... 36/137.1; 362/103; 350/98

[56] References Cited

U.S. PATENT DOCUMENTS

| | | | |
|---|---|---|---|
| 1,597,823 | 8/1926 | Randolph | 36/137 X |
| 2,572,760 | 10/1951 | Rikelman | 36/137 X |
| 3,070,907 | 1/1963 | Rocco | 36/137 X |
| 3,564,232 | 2/1971 | Ellerbe et al. | 362/103 |
| 3,893,247 | 7/1975 | Dana | 36/137 |
| 3,946,505 | 3/1976 | Dana | 36/137 |
| 4,020,572 | 5/1977 | Chiaramonte, Jr. | 36/137 |

FOREIGN PATENT DOCUMENTS

| | | | |
|---|---|---|---|
| 2227714 | 11/1974 | France | 36/137 |
| 483210 | 4/1938 | United Kingdom | 362/103 |

OTHER PUBLICATIONS

"Electronic Circuits Manual", by John Markus, copyright 1971 by McGraw-Hill, Incorporated, p. 251.

*Primary Examiner*—James Kee Chi

*Attorney, Agent, or Firm*—Cushman, Darby & Cushman

[57] ABSTRACT

A lighted shoe having a solid state oscillator circuit for causing periodic flashing on and off of a light associated with the shoe. A tilt switch may also be associated with the light or lights, and a three-position manual switch provided having one position wherein the light flashes periodically on and off, another position wherein the light is off, and yet another position wherein the tilt switch is inserted in the circuit with the light. The sole and heel may be formed of an integral piece of transparent rigid material, and an e.m.f. source, the circuit, the switch, and the light mounted on and in the integral piece. An AC adaptor is provided having two recharging plugs so that both shoes can be recharged at one time.

7 Claims, 2 Drawing Figures

FLASHING DISCOSHOES

BACKGROUND AND SUMMARY OF THE INVENTION

Lighted shoes, such as shown in the U.S. Pat. Nos. 3,893,247 and 3,946,505, have been provided in the past that include flashing lights associated therewith so that when an individual wearing the shoes moves back and forth, as during dancing or even while walking, the light or lights associated with the shoes flash on and off. While such shoes are very useful for many purposes, under some circumstances it is desirable to have the flashing of the light or lights associated with the shoes controlled periodically rather than in response to the movement of the wearer. According to the present invention, solid state oscillator circuitry means have been provided that are mounted directly in shoes for causing periodic flashing of the light source associated with the shoe on and off, no matter what the orientation of the shoe. Such oscillator circuitry means are also useful when the shoe is put on display so that someone viewing the shoe for possible purchase thereof can see the flashing action without the necessity of a person wearing the shoe moving it back and forth.

Also, according to the present invention, numerous structures have been provided that make the utilization of lighted shoes very practical and give them wide flexibility and allow ready construction of the shoes. Additionally, according to the present invention, the solid state circuitry means provided are simple enough so that they can be disposed right in the shoe, are simple and easy to manufacture, have a very low cost, and perform very well even under the fairly rough treatment they are sure to receive in being associated with the shoe. Such solid state circuit means preferably comprises a capacitor and a PNP transistor emitter connected in parallel with each other, in a series with an e.m.f. source and the light source, a voltage divider, and an NPN transistor operatively connected to the capacitor, PNP transistor gate, and e.m.f. source.

Additionally, a tilt switch, such as shown in the above-mentioned patents, can be associated with the shoe, a three-position switch being provided to either cut in the oscillator circuit, leave the lights off, or cut in the tilt switch—or the third position can be for leaving the light constantly on. A second light source (or even more light sources) may be provided, and a tilt switch or tilt switches may be arranged so that one light flashes on in the first orientation of the shoe and a second light flashes on in a second orientation of the shoe different from the first orientation, providing an extremely eye-catching effect. The e.m.f. source preferably comprises at least one rechargeable battery, and an AC adaptor is provided with two recharger plugs so that both shoes of a pair can be recharged at the same time.

It is the primary object of the present invention to provide a useful illuminated shoe that has great flexibility and is easy to maintain. This and other objects of the invention will become clear from an inspection of the detailed description of the invention, and from the appended claims.

DETAILED DESCRIPTION OF THE DRAWINGS

Figure 1:
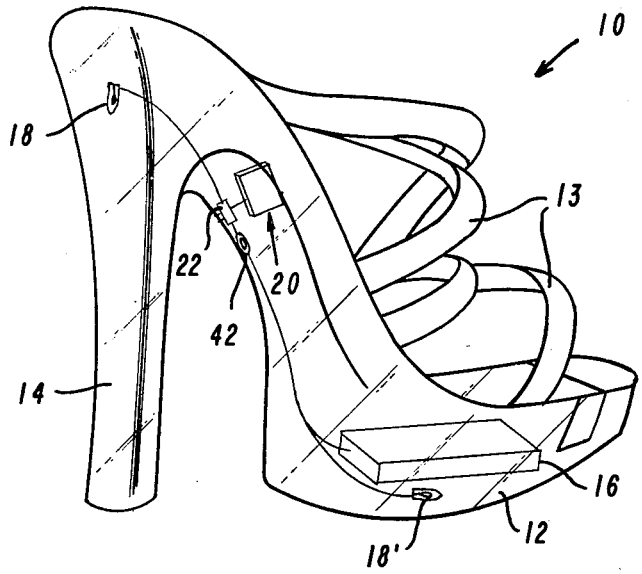
FIG. 1 is a perspective view of an exemplary shoe according to the present invention.

A shoe according to the present invention is shown in exemplary form at 10 in FIG. 1. The shoe includes a sole 12, an upper 13, and a heel 14. While the shoe is illustrated in the drawings as a woman's shoe of a style such that the upper 13 includes sandle tongs, it will be readily apparent that any style of shoe, both men's and women's, may be provided within the scope of the invention.

The shoe 10 also includes a source of e.m.f. 16, a light source 18 adapted to be operatively connected to the e.m.f. source 16, circuitry means 20 operatively connecting the source of e.m.f. 16 to the light source 18, the circuitry means comprising a solid state oscillator circuit means for causing periodic flashing of the light source on and off no matter what the orientation of the shoe (see FIG. 2), and switch means 22 for selectively connecting and disconnecting the solid state oscillator circuit means 20 to the e.m.f. source 16, the switch means including a manually actuated switch having a first position thereof wherein the solid state oscillator circuit means 20 connects the light source 18 to the source of e.m.f. 16 so that the light source periodically flashes, and a second position thereof wherein the circuit means 20 is disconnected from source 16 so that the light source 18 remains off. The circuitry means 20 may also comprise means 21—a direct line—from the source 16 to the light 18, in which case the switch 22 will have a third position wherein the light source is connected to the e.m.f. source 16 so that the light source is continuously on.

It is noted that in the embodiment of the shoe 10 illustrated in FIG. 1, the sole 12 and heel 14 are provided as a single integral structure formed of transparent material, and all of the elements 16, 18, 20 and 22 are mounted directly in or on the integral unit. The lines interconnecting the unit may be disposed on the top surface of the unit, or pass through bores in the unit.

Figure 2:
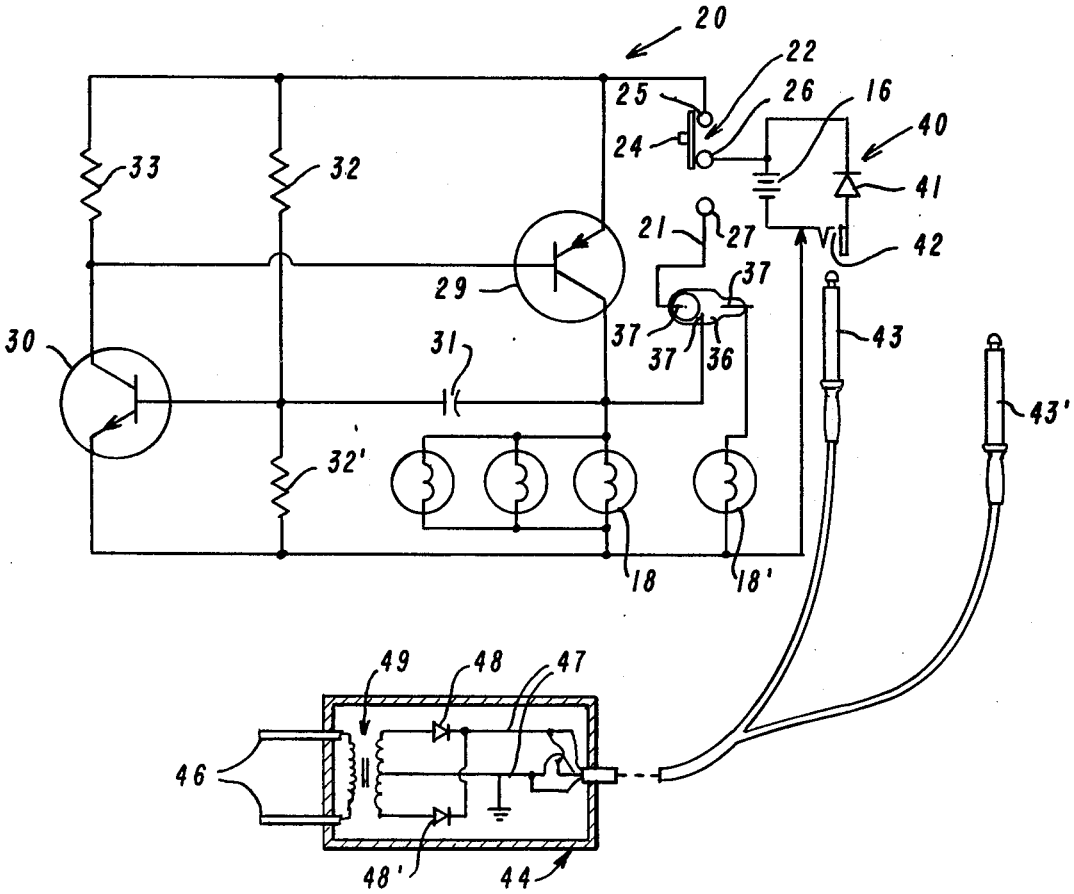
FIG. 2 is a schematic view showing an exemplary oscillator circuit and recharger utilizable with the shoe of FIG. 1.

The switch means 22 preferably comprises a push button or a slide switch, a slide switch being illustrated in the drawings. As seen in FIG. 2, the slide switch preferably includes a manual actuator 24 that has three positions—a first position wherein it bridges contacts 25 and 26 and connects the oscillator circuit means 20 with the battery 16 and light 18, a second position wherein it engages only the contact 26, whereby the light 18 remains off, and a third position wherein it bridges the contacts 26 and 27 connecting the battery 16 directly to the light 18 through line 21 so that the light 18 is constantly on, or—as described hereinafter—connecting the battery 16 to the light 18 through a tilt switch (36).

The oscillator circuit means 20 must be simple and of very low cost, yet must be capable of high performance even in the fairly rough environment of the shoe, and additionally must be capable of easy mounting in the shoe, as illustrated schematically in FIG. 1. An exemplary oscillator circuit that fulfills these criteria is shown schematically in FIG. 2, and includes first and second transistors 29, 30, a capacitor 31, a voltage divider provided by resistors 32 and 32', and a resistor 33. This circuit has only six simple components, yet properly effects operation of the light 18. As an inspection of FIG. 2 makes clear, the transistor 29 is a PNP transistor, and capacitor 31 and the emitter of transistor 29 are connected in parallel with each other, and in series with the battery 16 and light 18. The voltage divider 32, 32', the transistor 30, which is an NPN transistor, and the resistor 33 are operatively connected to the capacitor 31, the PNP transistor 29 gate, and the e.m.f. source 16. In one desired configuration, each of the elements of circuit means 20 may comprise the following standard components: transistor 29, 1502D; transistor 30, C1390; light source 18, 1303A; resistor 32, 33 K±5% ¼ W; resistor 32', 22 K±5% ¼ W; capacitor 31, 10 μF, 10 V; resistor 33, 560ω±5% ¼ W.

In the situation where it is desired that the third position of the switch be a position to effect flashing of the light source 18 in response to movement of the shoe, one or more tilt switches 36 may be provided connnected in the line 21. As illustrated in the drawings, two light sources 18, 18' are provided, one located in the heel and one located in the sole next to the battery 16, the mercury switch having contact means 37 for energizing the light source 18 when the shoe is in the first orientation, and for energizing the second light source 18' when the shoe is in a second orientation different from the first orientation. Alternatively, the single mercury switch 36 may be replaced by two different mercury switches, connected in parallel with each other and each connected in series with a light sources 18, 18', to effect the different flashing modes of the light sources 18, 18'.

Preferably, the e.m.f. source 16 comprises a pair of 1.2 volt nickel cadmium batteries, or other rechargeable type batteries, and a recharging switch arrangement 40 is provided associated with the batteries 16, including a diode 41 and a charging switch 42 for receipt of a charging plug 43 from a recharger 44, the recharging switch 42 preferably being located as illustrated in FIG. 1 so that it is normally hidden from view but so that it is readily accessible when recharging is desired. Also, the particular recharger 44 illustrated in FIG. 2 is especially useful with shoes according to the present invention since it includes a pair of recharger plugs 43, 43' connected up to the same main unit so that both shoes of a pair can be recharged at the same time. The recharger 44 includes prongs 46 that may be plugged into a conventional wall socket which supplies AC current at about 120 volts. Lines 47 lead from coils 49 through diodes 48, 48' to the plugs 43, 43'.

Operation

An individual places the shoe 10 on his feet and moves the actuator 24 for the switch means 22 from the middle, "off", position to either the flashing or constantly on position. When the actuator is moved so that it bridges contacts 25 and 26, current passes through the oscillator circuit means 20 and causes the light source 18 to flash on and off periodically. Preferably, the flash interval is about one second; however, by adjusting the capacitance of the capacitor 31, the interval of flash can be readily adjusted. Should the individual then wish the light 18 to remain constantly on, the individual merely moves the switch 24 so that it bridges contacts 26 and 27, and if a mercury switch 36 is provided in the line 21, then in the position where the actuator 24 bridges contacts 26 and 27, the light source 18, 18' will flash on and off depending upon the orientation of the shoe 10. Once the batteries 16 wear down, it is necessary only to move the switch actuator 24 to the "off" position, insert the plugs 43, 43' into the recharger switches 42 of a pair of shoes, and plug the prongs 46 into the wall, whereby recharging is effected.

It will thus be seen that according to the present invention, a simple, flexible illuminated shoe has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A shoe comprising
a sole,
an upper,
a heel,
a source of e.m.f.,
a light source adapted to be operatively connected to said source of e.m.f.,
circuitry means operatively connecting said source of e.m.f. to said light source, said circuitry means comprising solid-state oscillator circuit means for causing periodic flashing of said light source on and off no matter what the orientation of the shoe, and
switch means for selectively connecting and disconnecting said solid-state oscillator circuit means to said source of e.m.f., said switch means including a manually actuated switch having a first position thereof wherein said solid-state oscillator circuit means connects said light source to said source of e.m.f. so that said light source periodically flashes, and a second position thereof wherein said solid-state oscillator circuit means is disconnected from said e.m.f. source so that said light source remains off.

2. A shoe as recited in claim 1 wherein said circuitry means further comprises means for directly connecting said source of e.m.f. to said light source, and wherein said switch has a third position thereof wherein said light source is connected to said e.m.f. source through said circuitry means so that said light source is continuously on.

3. A shoe as recited in claim 1 wherein said e.m.f. source comprises at least one rechargeable battery, and further comprising a charging switch for receipt of a plug from a recharger; and further comprising, distinct from said shoe, a recharger for supplying current from an AC line to said at least one battery at the proper voltage for charging said at least one battery, said recharger having two recharger plugs operatively connected thereto so that both said shoe and another identical shoe can be recharged at the same time.

4. A shoe as recited in claim 1 wherein said solid-state circuit means comprises a capacitor and a PNP transistor emitter connected in parallel with each other and in series with said e.m.f. source and said light source, and further comprising a voltage divider and an NPN transistor operatively connected to said capacitor, PNP transistor gate, and e.m.f. source.

5. A shoe as recited in claim 1 wherein said circuitry means comprises shoe position responsive means for connecting said source of e.m.f. to said light source, said means including a tilt switch, and wherein said manual switch has a third position thereof wherein said tilt switch is connected between said source of e.m.f. and said light source so that said light source will flash on and off in response to the position of said shoe.

6. A shoe as recited in claim 5 further comprising a second light source operatively connected to said e.m.f. source through said tilt switch, and contact means for energizing said light source when said shoe is in a first orientation, and for energizing said second light source when said shoe is in a second orientation different from said first orientation.

7. A shoe as recited in claim 1 wherein said sole and said heel comprise an integral piece of transparent rigid material and wherein said e.m.f. source, light source, circuitry means, and switch means are mounted in said integral piece.

* * * * *

US004158922B1

REEXAMINATION CERTIFICATE (2502nd)

United States Patent [19]

[11] B1 4,158,922

Dana, III

[45] Certificate Issued Mar. 14, 1995

[54] FLASHING DISCOSHOES

[75] Inventor: Alfred Dana, III, Tampa, Fla.

[73] Assignee: L.A. Gear, Inc., Santa Monica, Calif.

Reexamination Request:
No. 90/003,409, Apr. 15, 1994

Reexamination Certificate for:

| | |
|---|---|
| Patent No.: | **4,158,922** |
| Issued: | **Jun. 26, 1979** |
| Appl. No.: | **890,805** |
| Filed: | **Mar. 27, 1978** |

[51] Int. Cl.[6] ..... A43B 23/00; F21L 15/08
[52] U.S. Cl. ..... 36/137; 362/103
[58] Field of Search ..... 36/137; 362/103, 802

[56] References Cited

U.S. PATENT DOCUMENTS

| | | | |
|---|---|---|---|
| 3,070,907 | 1/1963 | Rocco | 36/8.3 |
| 3,737,647 | 6/1973 | Gomi | 240/6.4 |
| 3,805,047 | 4/1974 | Dockstader | 240/6.4 |
| 3,893,247 | 7/1975 | Dana, III | 36/2.5 |
| 4,035,630 | 7/1977 | Burke | 240/6.4 |
| 4,076,976 | 2/1978 | Fenton | 362/104 |

FOREIGN PATENT DOCUMENTS 1144938 3/1969 United Kingdom .

OTHER PUBLICATIONS

Electronics Circuits Manual by John Markus, copyright 1971 by McGraw-Hill, Incorporated, p. 251.

*Primary Examiner*—Paul T. Sewell
*Attorney, Agent, or Firm*—Don C. Lawrence

[57] ABSTRACT

A lighted shoe having a solid state oscillator circuit for causing periodic flashing on and off of a light associated with the shoe. A tilt switch may also be associated with the light or lights, and a three-position manual switch provided having one position wherein the light flashes periodically on and off, another position wherein the light is off, and yet another position wherein the tilt switch is inserted in the circuit with the light. The sole and heel may be formed of an integral piece of transparent rigid material, and an e.m.f. source, the circuit, the switch, and the light mounted on and in the integral piece. An AC adaptor is provided having two recharging plugs so that both shoes can be recharged at one time.

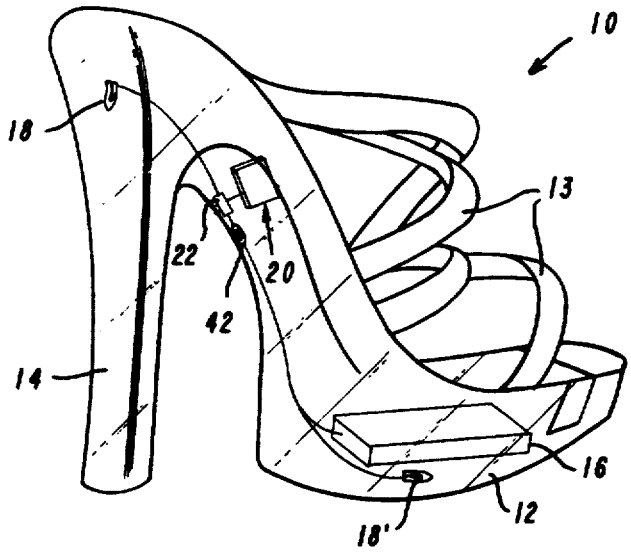

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–7 is confirmed.

* * * * *